US009085086B2

(12) United States Patent
Keijzer et al.

(10) Patent No.: US 9,085,086 B2
(45) Date of Patent: Jul. 21, 2015

(54) ELECTRIC APPARATUS AND A SHAVING APPARATUS

(75) Inventors: Bas Johannes Pieter Keijzer, Eindhoven (NL); Peter Edwin Kok, Mastenbroek (NL); Harold Wolf, Oranje (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 1083 days.

(21) Appl. No.: 12/663,528

(22) PCT Filed: Jun. 9, 2008

(86) PCT No.: PCT/IB2008/052247

§ 371 (c)(1),
(2), (4) Date: Dec. 8, 2009

(87) PCT Pub. No.: WO2008/152553

PCT Pub. Date: Dec. 18, 2008

(65) Prior Publication Data

US 2010/0180445 A1 Jul. 22, 2010

(30) Foreign Application Priority Data

Jun. 14, 2007 (EP) ..... 07110252

(51) Int. Cl.
*B26B 19/00* (2006.01)
*B26B 19/10* (2006.01)

(52) U.S. Cl.
CPC ..... *B26B 19/10* (2013.01); *B26B 19/102* (2013.01); *B26B 19/105* (2013.01)

(58) Field of Classification Search
CPC ..... B26B 19/102; B26B 19/105
USPC ..... 30/34.1, 43.4–43.6, 43.7–43.92
See application file for complete search history.

(56) References Cited

U.S. PATENT DOCUMENTS

| | | | | |
|---|---|---|---|---|
| 4,408,392 | A * | 10/1983 | Naimer | 30/34.1 |
| 5,084,967 | A * | 2/1992 | Nakagawa et al. | 30/34.1 |
| 5,105,541 | A | 4/1992 | Messinger et al. | |
| 5,507,095 | A * | 4/1996 | Wetzel et al. | 30/34.1 |
| 7,707,725 | B2 * | 5/2010 | Eichhorn et al. | 30/34.1 |
| 2005/0124392 | A1 | 6/2005 | Jeong | |
| 2005/0202687 | A1 | 9/2005 | Park | |
| 2005/0261041 | A1 | 11/2005 | Im | |

FOREIGN PATENT DOCUMENTS

| | | | |
|---|---|---|---|
| DE | 4125213 | A1 | 2/1992 |
| DE | 19531013 | C1 | 10/1996 |
| EP | 0398430 | A1 | 11/1990 |

(Continued)

*Primary Examiner* — Kenneth E. Peterson
*Assistant Examiner* — Samuel A Davies

(57) ABSTRACT

An electric apparatus comprises a housing (2) and a trimmer (3) for cutting hair. The trimmer (3) is carried by a trimmer supporting element (5) which is movable between a stored position and an operational position. In the operational position the trimmer (3) is spaced from the housing (2). The trimmer supporting element (5) is rotatably connected to the housing (2) through a supporting element hinge (8), which is movable with respect to the housing (2) via a guide (9) in a direction perpendicular to the axis of rotation of the supporting element hinge (8). The apparatus further comprises a displacement member (11) for defining the displacement of the trimmer supporting element (5) between the stored position and the operational position.

10 Claims, 8 Drawing Sheets

(56) References Cited

FOREIGN PATENT DOCUMENTS

| | | | | | |
|---|---|---|---|---|---|
| EP | 1295687 | A1 | | 3/2003 | |
| GB | 2073643 | A | | 10/1981 | |
| JP | 58032767 | | * | 3/1983 | ..... B26B 19/10 |
| JP | 2007105252 | A | * | 4/2007 | ..... B26B 19/10 |
| KR | 20040057219 | A | | 7/2004 | |
| WO | 2005002806 | A1 | | 1/2005 | |
| WO | 2005007354 | A1 | | 1/2005 | |

* cited by examiner

ELECTRIC APPARATUS AND A SHAVING APPARATUS

FIELD OF THE INVENTION

The invention relates to an electric apparatus, and more specifically a shaving apparatus comprising a trimmer for cutting hair.

BACKGROUND OF THE INVENTION

Certain electrical apparatus such as some types of shaving apparatus are provided with a trimmer for cutting relatively long hair, such as hair of a moustache. Patent application WO 2005/0007354 discloses a shaving apparatus comprising a trimmer which can be switched by a sliding button from a retracted position to an operational position in which the trimmer projects from the housing of the apparatus.

SUMMARY OF THE INVENTION

It is desirable that in the operational position the trimmer is located further away from the sliding button than in the case of the prior art apparatus. In particular for shaving apparatus including a trimmer it is desired to locate the trimmer closer to the plane through the shaving heads so as to allow precise hair cutting in a comfortable manner. It would be advantageous to provide an electric apparatus which satisfies the desires mentioned above.

The desires are addressed by the electric apparatus according to a first aspect of the invention including an electric apparatus with three hinges having substantially parallel axes of rotation for allowing movement of a trimmer between stored and operational positions. The advantage of the features as described is that the electric apparatus provides greater flexibility in design regarding the trimmer's stored and operational position than in the case of only a rotational displacement or only a slidable displacement of the trimmer supporting element with respect to the housing. Furthermore, the desired position of the trimmer in operation can be achieved without rotating the trimmer supporting element through a large angle, as would be necessary with the prior art apparatus as mentioned above. Therefore the invention makes it possible to provide a compact mechanism for the apparatus.

In the stored position the trimmer supporting element may be retracted within the housing such that the outer side of the housing has a substantially smooth surface when the trimmer is not used, but other positions of the trimmer supporting element are conceivable. Furthermore, the trimmer may be driven by a drive mechanism.

The apparatus further includes a guide that extends substantially parallel to an outer side of the housing for guiding the hinges of the trimmer supporting element. This provides the opportunity to store the trimmer supporting element along the outer side of the housing, from where it can be both flipped and slid into the operational position, such that the trimmer reaches a desired operational position with respect to the housing. Due to the movable axis of rotation of the supporting element hinge, the trimmer supporting element can be displaced in a certain direction along the housing and at the same time in a direction away from the housing.

The displacement member is adapted and positioned such that the direction of movement of the trimmer with respect to the housing has a component in the direction of movement of the supporting element hinge. The advantage of these features is that the movement of the trimmer supporting element is both upward and forward, which means that a frontal position of the trimmer supporting element rises from the housing in the direction of movement of the movable supporting element hinge. This improves the user friendliness of the apparatus.

The displacement member supports the trimmer supporting element in a supported portion thereof spaced from the supporting element hinge. The advantage of these features is that the trimmer supporting element is maintained in a stable position in the operational position. Thus, the displacement member both guides the trimmer supporting element from the stored position to the operational position and supports the trimmer supporting element when it is in the operational position.

Since the displacement member is connected both to the housing and the trimmer supporting element, it is possible to lock the trimmer supporting element in the operational position through locking the displacement member with respect to the housing.

A cover of a flexible material may cover a space between the trimmer supporting element and the activating member. This improves the appearance of the apparatus and prevents the space between the activating member and the trimmer supporting element from being penetrated by undesired material, such as dust.

The above-mentioned aspects and other aspects of the invention will be apparent from the following description, with reference to the drawings.

DETAILED DESCRIPTION OF EMBODIMENTS

Figure 1:
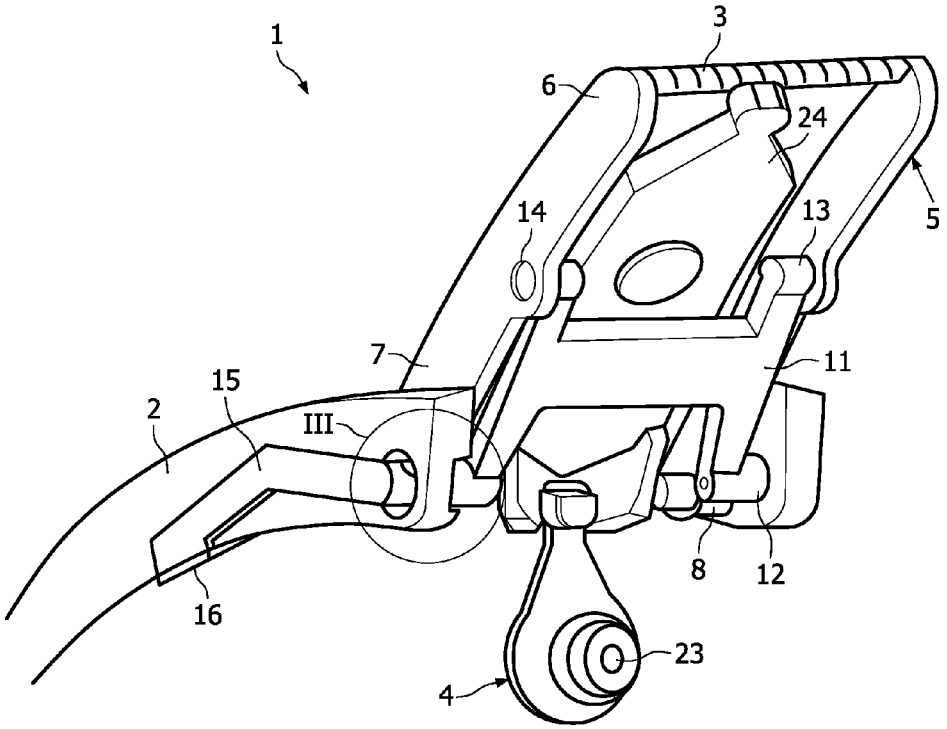
FIG. 1 is a perspective view of a part of an embodiment of an electric apparatus according to the invention.

FIG. 1 shows a part of an embodiment of an electric apparatus according to the invention, in this case a shaving apparatus 1 (see also FIG. 4). The shaving apparatus 1 comprises a housing 2, a trimmer 3 and a drive mechanism 4 for driving the trimmer 3. The trimmer 3 serves for cutting relatively long hairs such as hairs of a moustache. The trimmer 3 is carried by a trimmer supporting element 5, which is movable between a stored position and an operational position. FIG. 1 shows the operational position in which position the trimmer 3 is spaced from the housing 2, due to the fact that the trimmer supporting element 5 projects from the housing 2.

The trimmer 3 is disposed at a free distal end portion 6 of the trimmer supporting element 5. A proximal end portion 7 of the trimmer supporting element 5 is connected to the housing 2 through a supporting element hinge 8. This means that the trimmer supporting element 5 is rotatable with respect to the housing 2 about an axis of rotation of the supporting element hinge 8. Furthermore, the supporting element hinge 8 is movably connected to the housing 2 such that its axis of rotation is movable with respect to the housing 2 via a guide 9, see FIG. 2. The direction of movement of the supporting element hinge 8 is perpendicular to the axis of rotation thereof and substantially parallel to the adjacent housing wall.

Figure 2B:
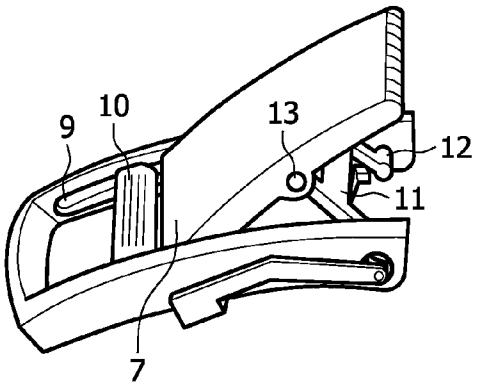
FIGS. 2*a*-2*d* are perspective top views of the embodiment of FIG. 1 on a smaller scale, illustrating subsequent positions of the trimmer supporting element from the stored position to the operational position thereof.
Figure 2D:
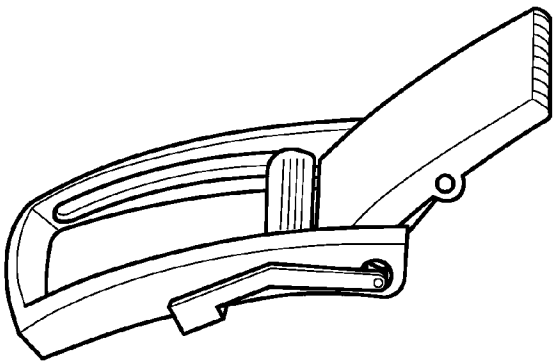
Figure 2A:
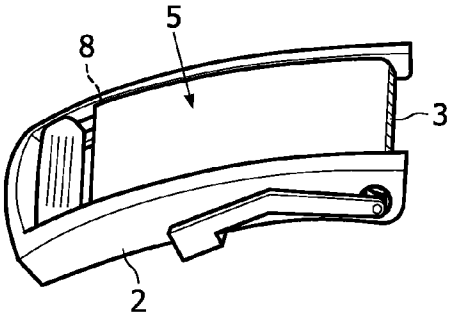
Figure 2C:
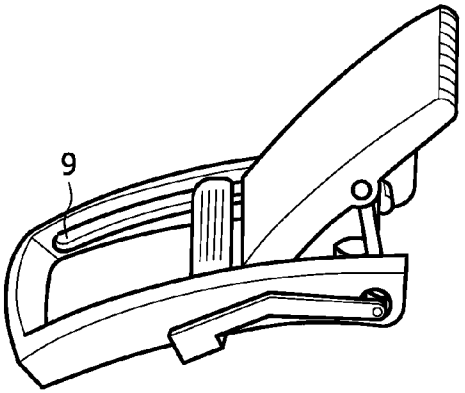

In FIGS. 2*a*-2*d* it is illustrated that an activating member 10 is attached to the proximal end portion 7 of the trimmer supporting element 5. The activating member 10 is slidable with respect to the housing 2, in this case also along the guide 9 in the housing 2, and is therefore rotatably connected to the trimmer supporting element 5. FIGS. 2*a* and 2*d* show the stored position and the operational position of the trimmer supporting element 5, respectively. FIGS. 2*b* and 2*c* show intermediate positions between the stored position and the operational position thereof. As can be seen in FIG. 2*a* the trimmer supporting element 5 is refracted within a recess of the housing 2 in the stored position such that a back side of the trimmer supporting element 5 is substantially flush with the outer wall of the adjacent housing 2.

The shaving apparatus 1 is further provided with a displacement member 11 for defining the displacement of the trimmer supporting element 5 between the stored position and the operational position. This means that the displacement member 11 defines the movement path of the trimmer supporting element 5. In the embodiment as shown in FIG. 1, the displacement member 11 is rotatably connected to the housing 2 at a first displacement member hinge 12, and rotatably connected to the trimmer supporting element 5 at a second displacement member hinge 13. The second displacement member hinge 13 is spaced from the supporting element hinge 8. In the embodiment as shown in FIG. 1, the second displacement member hinge 13 is located about halfway the trimmer supporting element 5 as seen in the longitudinal direction thereof. The hinges 8, 12 and 13 have axes of rotation which are substantially parallel to each other. The displacement member 11 supports the trimmer supporting element 5 in a supported portion 14 thereof. The displacement member is made of a plate-like material and is H-shaped in this embodiment. Alternative shapes are conceivable, of course.

In FIGS. 2*a*-2*d* it can be seen that the displacement member 11 rotates the trimmer supporting element 5, with the trimmer 3 moving away from the housing 2 when the supporting element hinge 8 is moved along the guide 9. Due to the structure of this embodiment the direction of movement of the trimmer 3 has a component in the direction of movement of the supporting element hinge 8.

Figure 8:
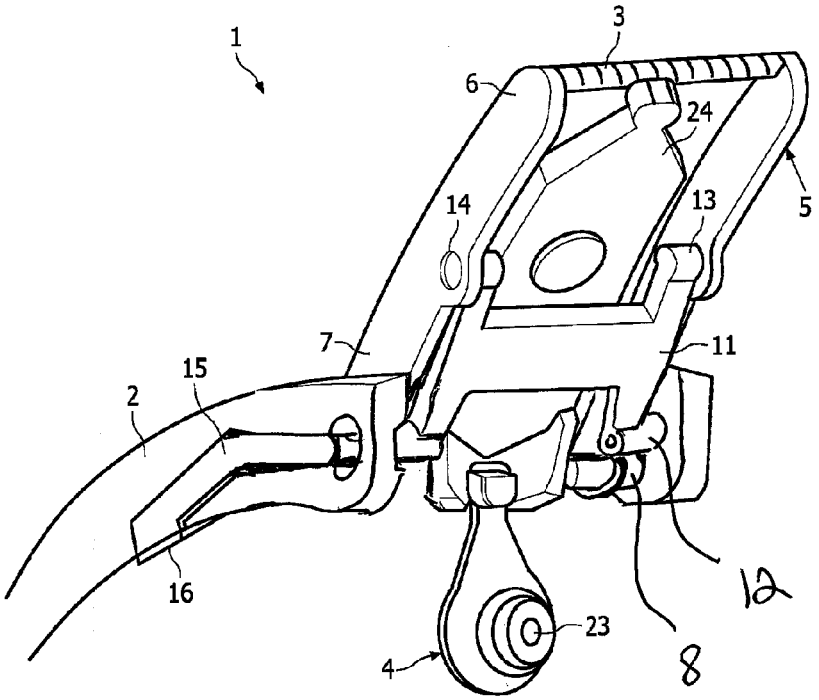
FIG. 8 is a perspective view of a part of another embodiment of an electric apparatus according to the invention.

In an alternative embodiment to that of FIG. 1, the displacement member 11 and the trimmer supporting element 5 could be positioned and shaped such that the axes of rotation of the first displacement member hinge 12, the second displacement member hinge 13 and the supporting element hinge 8 substantially extend within a plane when the trimmer supporting element 5 is in the operational position, as shown in FIG. 8. In this case the displacement member 11 and the trimmer supporting element 5 are aligned such that in the operational position the displacement member 11 is not seen as a separate element with respect to the trimmer supporting element 5. The displacement member 11 may, for example, be partly enveloped by the trimmer supporting element 5, such as shown in FIG. 2*d*, for example.

The embodiment of the shaving apparatus 1 as shown in FIG. 1 is also provided with a locking member for releasably locking the trimmer supporting element 5 in the stored position and the operational position. The locking member comprises a resilient element 15 having an attachment portion 16 which is attached to the housing 2. The resilient element 15 comprises a leaf spring which is provided with a coupling 17 located at a distance from the attachment portion 16, see FIG. 3. The coupling 17 fits a counter coupling 18 located on the displacement member 11. The coupling 17 and counter coupling 18 are formed by a mutually matching projection 19 and recess 20, respectively, at the first displacement member hinge 12. The projection 19 and recess 20 are oriented in the direction of the axis of rotation of the first displacement member hinge 12.

Figure 3:
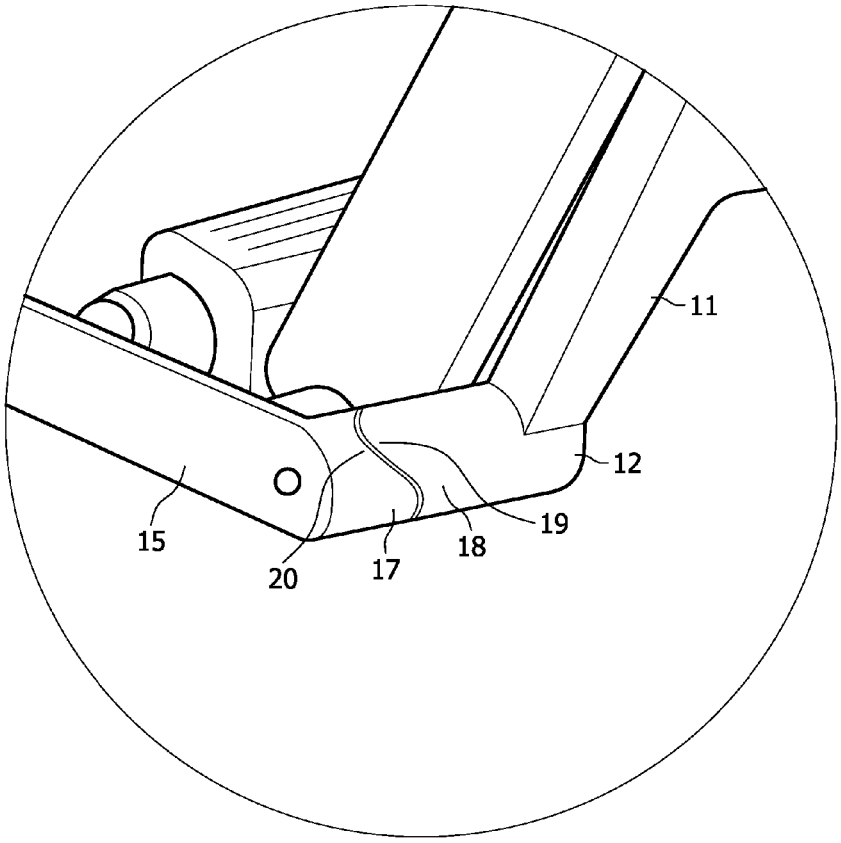
FIG. 3 is an enlarged view of a part of detail III of FIG. 1.

The leaf spring of the resilient element 15 presses the projection 19 and the recess 20 towards each other in the direction of the axis of rotation of the first displacement member hinge 12. This means that at a certain rotational position of the displacement member 11 with respect to the resilient element 15, the coupling 17 and counter coupling 18 lock the displacement member 11 to the housing 2. However, although they are fitted together, the coupling 17 and the counter coupling 18 are releasable by virtue of the resilience of the resilient element 15. This is achieved by the gradual shape of the projection 19 and recess 20. When applying a rotational force on the displacement member 11 the leaf spring is pressed away from the first displacement member hinge 12 in the direction of the axis of rotation thereof. FIG. 3 shows the condition of the locking member in the operational position of the displacement member 11. When the displacement member 11 is rotated due to a movement of the trimmer supporting element 5 from the operational position to the stored position, the resilient element 15 is pressed outward and the projection 19 moves along a projection of the coupling 17 such that the projection 19 ends beyond an apex of the projection of the coupling 17 in the stored position. Since the resilient element 15 causes a force acting between the coupling 17 and the counter coupling 18, the displacement member 11 is maintained in the stored position as long as a rotational force on the displacement member 11 remains below a predetermined level, which depends on the resilience of the resilient element 15.

Figure 4B:
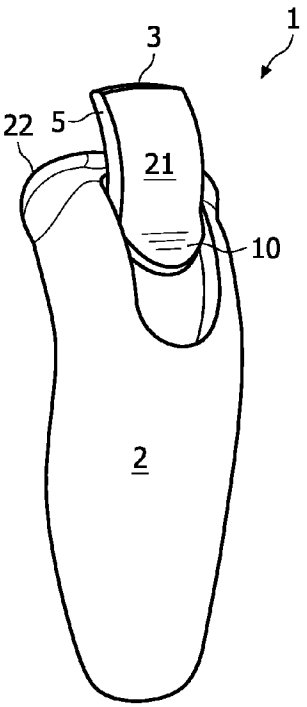
FIGS. 4*a-b* are perspective front and rear views of an embodiment of a shaving apparatus, illustrating a covered back side of the supporting element and activating member of FIG. 2.

As shown in FIGS. 2*a*-2*d* the activating member 10 and the trimmer supporting element 5 are adjacent to each other in the longitudinal direction of the guide 9. It can also be seen that there is a space between the trimmer supporting element 5 and the activating member 10. FIG. 4*b* shows an embodiment of a shaving apparatus 1, of which both a backside of the trimmer supporting element 5 and an upper surface of the activating member 10, both facing away from the housing 2, are covered by a flexible cover 21 which also covers the space between the trimmer supporting element 5 and the activating member 10. When the trimmer supporting element 5 is in the stored position the flexible cover 21 is preferably flush with the outer side of the housing 2.

Figure 4A:
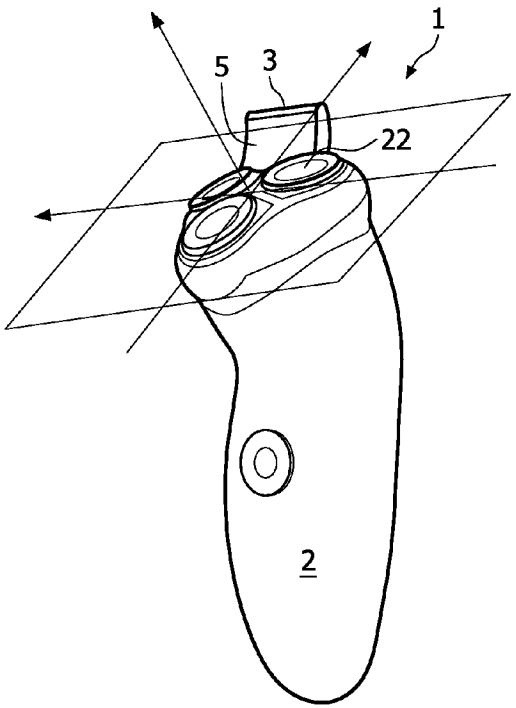

FIG. 4*a* shows that in the operational position of the trimmer supporting element 5 the trimmer 3 is located close to the plane through shaving heads 22 of the shaving apparatus 1. In the operational position the trimmer may be disposed near or within, or project through, the mentioned plane. For the user this appears to improve the angle of visibility of the location where the trimmer is used.

FIG. 1 shows that the drive mechanism 4 comprises a reciprocating drive element 23 and a transmission lever 24 for transmitting the movement of the drive element 23 to the trimmer 3. In this embodiment the trimmer supporting element 5 accommodates the transmission lever 24. The transmission lever 24 is rotatably connected to the trimmer supporting element 5.

Figure 5:
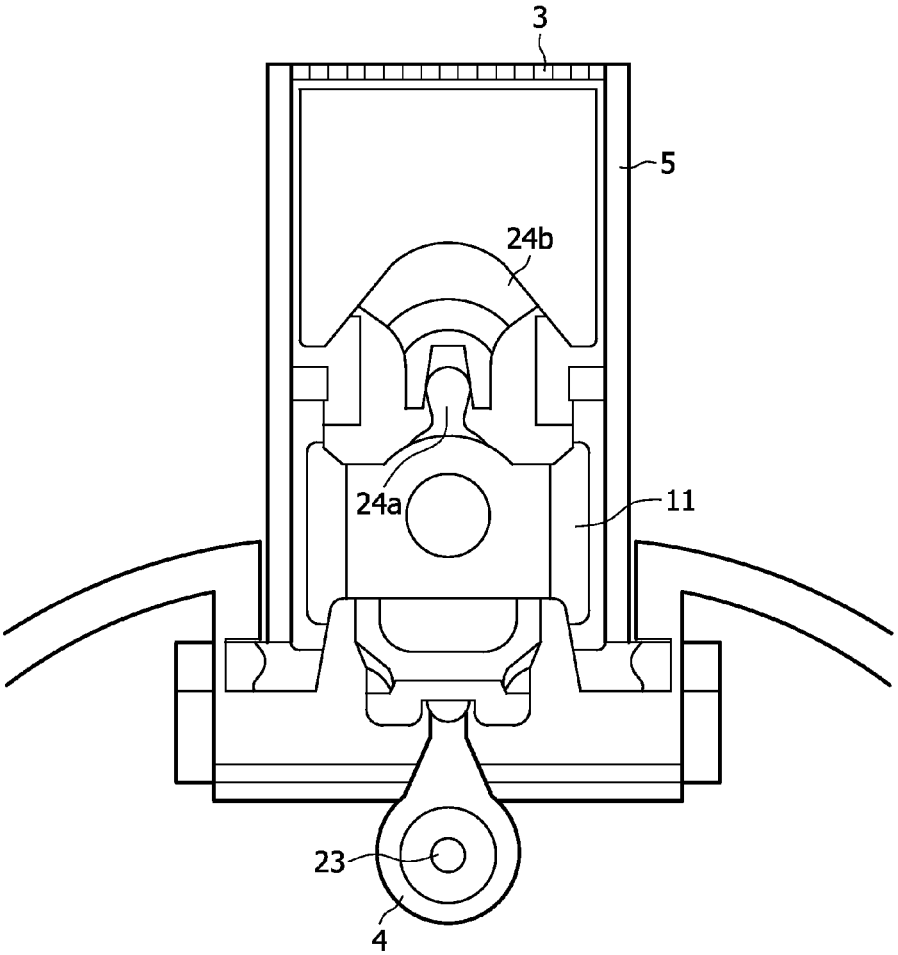
FIG. 5 is a frontal view of a part of an alternative embodiment of an electric apparatus according to the invention.

FIG. 5 shows an alternative embodiment of the drive mechanism 4. In this case the transmission lever comprises a lower transmission part 24*a* and an upper transmission part 24*b*. The lower part 24*a* is rotatably connected to the displacement member 11. The advantage of a transmission lever in two parts 24*a*, 24*b* is that in this case a relatively wide angle between the trimmer supporting element 5 and the displacement member 11 is allowed in the operational position. The drive element 23 is positioned and shaped such that it is automatically coupled to the transmission lever 24 or lower part 24*a* when the trimmer supporting element 5 is in the operational position.

Figure 6:
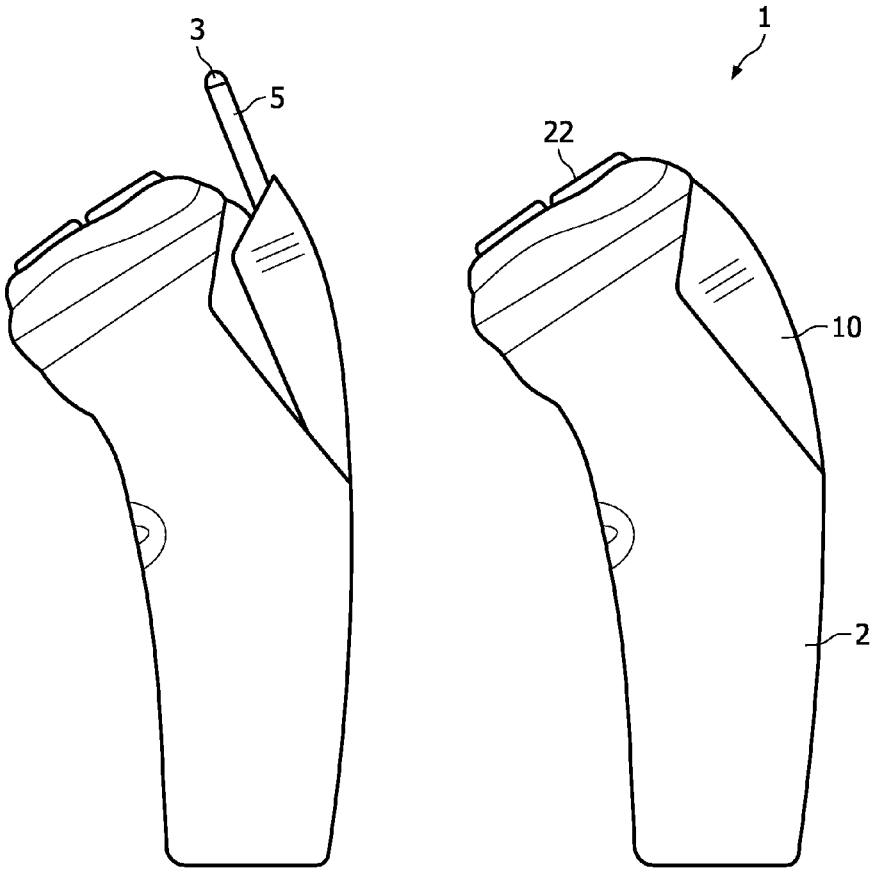
FIG. 6 shows side views of still another alternative embodiment of an electric apparatus according to the invention, illustrating the trimmer supporting element in operational position (left drawing) and stored position (right drawing).
Figure 7:
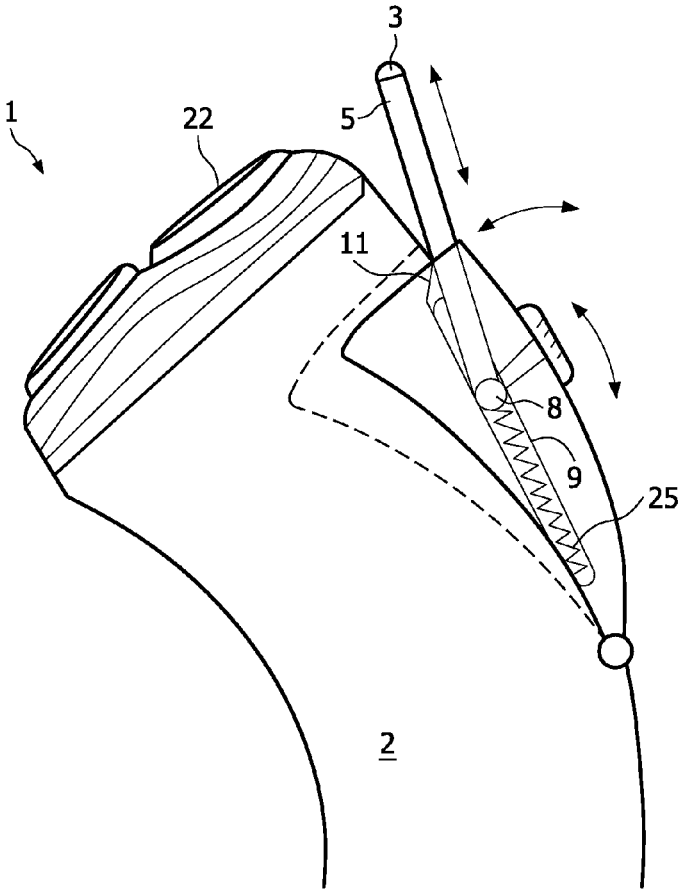
FIG. 7 is a schematic sectional view of a part of the embodiment of FIG. 6.

FIG. 6 shows an alternative embodiment of a shaving apparatus 1 according to the invention. In this case the activating member 10 is a relatively large button which unlocks the trimmer supporting element 5 from its stored position when the activating member 10 is moved downwardly along the housing 2 away from the shaving heads 22. Upon this movement the trimmer supporting element 5 is pushed upwardly by a spring 25, see FIG. 7.

In this embodiment the supporting element hinge 8 is movable through the guide 9. The displacement member 11 for defining the displacement of the trimmer supporting element 5 between the stored position and the operational position is formed by a wall which is part of the housing 2. The displacement member 11 also supports the trimmer supporting element 5 in the operational position thereof. In this embodiment the locking member is formed by the spring 25, but several alternative mechanisms are conceivable.

From the foregoing it will be clear that the invention provides a compact and relatively simple mechanism for moving the trimmer to a desired position with respect to the housing.

The invention is not restricted to the above-described embodiments as shown in the drawings, which can be varied in several ways without departing from the scope of the claims. Features of the various embodiments may be combined. The electric apparatus is not limited to a shaving apparatus, but alternative apparatus including a trimmer are possible, such as an electric apparatus having a first trimmer for relatively long hair and a second trimmer for short hair, for example.

In general it is noted that, in this application, the expression "comprising" does not exclude other elements or steps, and "a" or "an" does not exclude a plurality. Reference signs in the claims shall not be construed as limiting the scope thereof.

The invention claimed is:

1. An electric apparatus comprising:

a housing;

a trimmer for cutting hair, the trimmer being carried by a trimmer end of a trimmer supporting element and the trimmer extending from the trimmer end of the trimmer supporting element along a longitudinal axis of the trimmer supporting element such that a width of the trimmer is perpendicular to the longitudinal axis, wherein the trimmer supporting element is movable between a stored position and an operational position, wherein in the operational position the trimmer is spaced from the housing, wherein a hinged end of the trimmer supporting element is opposite the trimmer end along the longitudinal axis and is directly rotatably connected to the housing through a supporting element hinge, and wherein the hinged end of the supporting element hinge is movable with respect to the housing in a guide in a direction perpendicular to an axis of rotation of the supporting element hinge for tilting the trimmer supporting element away from the housing by an angle formed between the housing and the hinged end; and a displacement member for defining the displacement of the trimmer supporting element between the stored position and the operational position, wherein the displacement member is rotatably connected to the housing at a first displacement member hinge and to the trimmer supporting element at a second displacement member hinge spaced from the supporting element hinge, the first displacement member hinge and the second displacement member hinge comprising first and second axes of rotation, respectively, which are substantially parallel to the axis of rotation of the supporting element hinge, and wherein the hinged end of the trimmer supporting element is located further away from the trimmer than the trimmer end of the trimmer supporting element and wherein the displacement member and the trimmer supporting element are positioned and shaped such that the axes of rotation of the first displacement member hinge, the second displacement member hinge and the supporting element hinge substantially extend within a plane when the trimmer supporting element is in the operational position, and the displacement member and the trimmer supporting element are aligned.

2. The electric apparatus according to claim 1, wherein the guide extends substantially parallel to an outer side of the housing, and the displacement member is connected to the housing and the trimmer supporting element such that the displacement member rotates the trimmer supporting element away from the housing to move the trimmer end of trimmer supporting element in a first direction away from the housing when the supporting element hinge is moved along the guide to move the hinged end of the trimmer supporting element in a second direction parallel with the housing.

3. The electric apparatus according to claim 2, wherein the displacement member is configured and positioned such that a direction of movement of the trimmer with respect to the housing has a component in a direction of movement of the supporting element hinge so that the trimmer supporting element moves in two different directions with respect to the housing.

4. The electric apparatus according to claim 1, wherein at least in the operational position the displacement member is engaged with the housing and the trimmer supporting element such that the displacement member supports the trimmer supporting element in a supported portion thereof spaced from the supporting element hinge.

5. The electric apparatus according to claim 1, comprising a locking member for releasably locking the trimmer supporting element in a selected position.

6. The electric apparatus according to claim 5, wherein the locking member locks the displacement member and the housing with respect to each other in at least the operational position.

7. The electric apparatus according to claim 6, wherein the locking member comprises a resilient element which, at an attachment portion thereof, is attached to the housing and is provided with a coupling which is located at a distance from the attachment portion, and which coupling fits a counter coupling located on the displacement member at least in the operational position, which coupling and counter coupling lock the displacement member to the housing when they are fitted together, and which coupling and counter coupling are releasable by virtue of the resilience of the resilient element.

8. The electric apparatus according to claim 7, wherein the resilient element comprises a leaf spring and the coupling and counter coupling are formed by at least a fitting projection and recess in the circumferential direction of the first displacement member hinge and the coupling, respectively, and the projection and recess are oriented in the direction of the axis of rotation of the first displacement member hinge, and wherein the leaf spring is adapted such that it presses the projection and recess towards each other, the projection and recess having a gradual shape such that upon applying a rotational force on the displacement member the leaf spring is pressed away from the first displacement member hinge in the direction of the axis of rotation thereof.

9. The electric apparatus according to claim 1, wherein the trimmer supporting element is rotatably connected to an activating member which is slidably connected to the housing so as to enable a user to move the supporting element hinge along the guide.

10. The electric apparatus according to claim 9, wherein the activating member and the trimmer supporting element are adjacent to each other in the longitudinal direction of the guide, and both a back side of the trimmer supporting element and a surface of the activating member, both facing away from the housing, are covered by a flexible material which also covers a space between the trimmer supporting element and the activating member.

* * * * *